US007712516B2

(12) United States Patent
Gerlach

(10) Patent No.: US 7,712,516 B2
(45) Date of Patent: May 11, 2010

(54) MOLDING MATERIAL, FOUNDRY MOLDING MATERIAL MIXTURE AND PROCESS OF PRODUCING A MOLD OR A MOLDING PART

(75) Inventor: Ralf-Joachim Gerlach, Krefeld (DE)

(73) Assignee: Minelco GmbH, Essen (DE)

( * ) Notice: Subject to any disclaimer, the term of this patent is extended or adjusted under 35 U.S.C. 154(b) by 286 days.

(21) Appl. No.: 11/832,001

(22) Filed: Aug. 1, 2007

(65) Prior Publication Data

US 2008/0029240 A1 Feb. 7, 2008

(30) Foreign Application Priority Data

Aug. 2, 2006 (DE) ..... 10 2006 036 381

(51) Int. Cl.
*B22C 1/00* (2006.01)

(52) U.S. Cl. ..... 164/529; 164/520

(58) Field of Classification Search ..... 164/520–529
See application file for complete search history.

(56) References Cited

FOREIGN PATENT DOCUMENTS

JP 52-124414 * 10/1977

* cited by examiner

*Primary Examiner*—Kuang Lin
(74) *Attorney, Agent, or Firm*—Nils H. Ljungman & Associates

(57) ABSTRACT

The molding material or molding part for foundry purposes, comprising 1-10% of binding agent based on alkali silicate, an aggregate containing 1-10 percent by weight of amorphous silicon dioxide, remainder quartz sand with a grain size range of 0.01 to 5 mm, and to a process of producing a molding material and molding parts. The abstract of the disclosure is submitted herewith as required by 37 C.F.R. §1.72 (b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

18 Claims, No Drawings

MOLDING MATERIAL, FOUNDRY MOLDING MATERIAL MIXTURE AND PROCESS OF PRODUCING A MOLD OR A MOLDING PART

The embodiments of the invention relate to a molding material or molding part for foundry purposes, comprising of 1-10% of binding agent based on alkali silicate, an aggregate containing 1-10 percent by weight of amorphous silicon dioxide, remainder quartz sand with a grain size range of 0.01 to 5 mm, and to a process of producing a molding material and molding parts.

As understood at the time of filing, a molding sand mixture of the above-mentioned type is known from DE 10 2004 042 535 wherein there is described a molding material mixture which provides an improved green strength and humidity resistance of the molding parts produced therefrom without substantially affecting the end strengths relative to a water glass binding agent without an amorphous silicon dioxide.

As understood at the time of filing, a high flow resistance of a molding material or of a molding material mixture while being filled into a mold in a core molding machine results in irregular flowing conditions in the course of which the molding material flow is subjected to changing flow speeds and shear forces. Irregular flowing can aversely affect the quality of the molding parts, more particularly in the case of profiles with fine parts, and the surface of the molding parts. Furthermore, irregular flowing can cause a non-uniform density of the molding parts. The non-uniform density causes in a disadvantageous consolidation behavior of the molding parts and can result in partially porous molding part portions and an inhomogeneous thermal conductivity behavior.

As understood at the time of filing, from DE 10 2004 042 535 it is known to adjust the flowing characteristics of a mixture by adding platelet-like additives such a graphite or $MOS_2$. However, this increases the risk of irregular cross-linking because especially platelet-like additives, along their planar sides and in a locally limited way, can form binding agent bridges with adjoining molding material particles during the drying process. In respect of their number, size and stability, the binding agent bridges between the side faces of such platelet-like additives and adjoining molding material particles can be subject of unpredicted fluctuations as compared to binding agent bridges formed directly between molding material particles. Such additional local cross-linking of molding material particles via platelets changes the properties of the molding parts in a way which cannot be controlled locally. If groups of molding material particles with a high degree of cross-linking are unevenly distributed, a uniform behavior of the dried mold during casting is no longer guaranteed. A group of molding material particles, as a result of platelet-like additives, can form strong individual binding agent bridges which firmly cross-link several particles within the particle group, which means that there can, subsequently, result casting errors up to the point of failure of the molding part.

As understood at the time of filing, on the other hand, the platelet-like additives in the molding material mixture, via their geometric shape, provide the gliding faces necessary to improve the flowing ability. In the case of platelet-like additives, composition and processing of a molding material mixture, in accordance with the state of the art, have to be adjusted in complex test series to the properties of the molding parts to be produced, such as a sand core.

The sand cores required in a foundry are produced in core molding machines. The molding material containing core sand, binding agent and admixtures are shot at a high speed into a core box through sudden expansion of a limited volume of compressed air.

To achieve the shortest possible cycle times and a cost-effective operation of the plant, the speed at which the core sand is shot in, is continuously increased.

Problems arise in connection with the material transport and the densification of the molding material in the core box. At such high shooting speeds, complex core molds having shapes with small dimensions are no longer completely or evenly filled.

To solve this problem, processes according to the state of the art describe measures such as subsequent densification, multi-stage shooting methods or partially liquid reactive molding materials which harden slowly in the core box. Such measures are connected with more and sophisticated devices and/or longer cycle times, which adversely affects an accelerated, cost-effective production of cores, molds or molding parts. Furthermore, cross-linking by reactive molding materials is difficult to control. To achieve a uniform cross-linking reaction, the molding material mixture would have to be made to react homogeneously with a uniform layer thickness. Molding parts, in their spatial characteristics, however, are designed for a locally varying heat distribution during the casting process. Reaction heat as well as reaction products such as water or $CO_2$ released during the reaction process influence the reaction process. In certain differently thick regions of the molding part, this leads to a pronounced cross-linking of the molding material particles which, in turn, influence the properties of the molding part during the casting process. When reactive molding materials are used, complex castings require complicated and accurately controlled production sequences for the molding parts to be able to achieve sufficiently uniform molding parts properties for casting purposes.

Cross-linking is not only important for the achievable strength properties, but also for the later disintegration behavior. On the one hand, the molding material or the molding part is to achieve a high green strength within the shortest possible time. On the other hand, the core produced is to be able to withstand high thermal loads during the casting operation without losing its dimensional stability. After the completion of the casting operation, the framework of the core is to comprise good disintegration properties, i.e. it should be possible for it to be returned to its original components with simple means.

It is the object of the embodiments of the present invention to provide embodiments to develop a molding material or a molding part and a process of producing same which permit a high quality of the sand cores and a uniform densification of the molding material particles by means of a cost-effective process. Furthermore, the thermal load bearing capacity of the molding parts produced is to be improved to such an extent that it is also possible to carry out modern casting processes with longer service lives of the mold. Thereafter, it should be possible to easily destroy the mold and the core with mechanical means and to transfer same into their starting components.

In the sense of embodiments of the present invention the following are used: 1 to 10 percent by weight of amorphous, spherical, partially dissolved $SiO_2$, wherein there is contained a maximum of 1.5 percent by weight of particles with a diameter of 45 or more micrometers in a mixture of quartz sand and a binding agent on an alkali silicate basis. On the surface of the silicon dioxide there is to be formed a swelling phase which comprises a thickness of 0.5-1% with reference to the mean grain diameter.

"Partially dissolve" in the sense of the embodiments of the present invention means that on the amorphous $SiO_2$ having a purity in excess of 85% in a suspension with a pH-value of 9 to 14, there is formed a swelling phase. The swelling phase occurs in the form of a layer on the amorphous $SiO_2$ while forming a spatial network of inter-connected silicate groups of the amorphous $SiO_2$. The cavities between the silicate groups are filled by an alkaline liquid, with individual oxygen bridges being broken by 2 $OH^-$ ions of the alkaline liquid and, while there is produced a $H_2O$ molecule, replaced by two negatively loaded, separate —$O^-$ groups, with the cavities of the network being widened. By widening the cavities in the swelling phase, there occur locally delimited adhesion islands. By widening the mean grain diameter of the original dry $SiO_2$ during the partial dissolution process, there is obtained a particle diameter which is increased by to 2%. In the partially dissolved condition, the amorphous, spherical $SiO_2$ comprises a swelling phase in the form of a gel layer with a stable structure. In the sense of the present embodiment of the invention, an amorphous $SiO_2$ with such a swelling phase is also alkaline.

It is believed at the time of filing that if the percentage of amorphous $SiO_2$ with a grain size in excess of 45 micrometers is greater than 1.5%, there are obtained molding material mixtures with a fluctuating flowing ability which, in addition, require a longer drying time for achieving the necessary green strength. With greater $SiO_2$ spheres, the total number of $SiO_2$ spheres per weight percentage decreases as well as the size of the surface made available by the particles. Furthermore, with an increasing diameter, the particles comprise an angle of curvature which decreases per length unit. By placing greater particles one above the other, the reduced angle of curvature leads to a larger contact surface which permits firmer cohesion and stronger agglomeration. An uneven distribution and uneven cross-linking of the individual particles can be explained by agglomerates in combination with the decreasing total number of $SiO_2$ spheres.

It is believed at the time of filing that if at 1 to 10% of amorphous $SiO_2$ with spherical grain with a mean grain diameter between 10 and 45 micrometers, the percentage of grains with a grain size in excess of 45 micrometers amounted to less than 1.5%, it was possible, with a constantly improved flowing ability and a uniform drying time, to produce molds and molding parts. The spherical $SiO_2$ particles are evenly distributed between the quartz sand particles in the form of sliding mediators; they space the quartz sand particles from one another and prevent the blocking effect of the interlocking action of the quartz sand particles. Mutual sliding takes place via the stable swelling phase on the surface which provides an improved mobility of the quartz sand particles relative to one another during the flowing process.

It is believed at the time of filing that if the degree of purity of the $SiO_2$ is less than 85%, the chemical behavior of individual $SiO_2$ spheres during partial dissolution is locally changed by the impurities, with the widening of the grain diameter varying considerably. This can be explained by an unstable, uneven swelling layer. Molding parts produced with an amorphous $SiO_2$ with a degree of purity of less than 85% comprise a greatly fluctuating inclination of molding material particles to adhere to the metal after casting. If the degree of purity of the $SiO_2$ exceeds 85%, molding material particles of molding parts produced regularly comprise a reduced inclination to adhere to the metal after casting.

In accordance with embodiments of the invention, the partially dissolved, spherical $SiO_2$ is added to the molding material in a quantity of 1 to 10% by weight. The inventors at the time of filing assume that the swelling phase which surrounds the spherical $SiO_2$ particles exhibits a clearly reduced degree of adhesion and sliding friction as compared to the adjoining quartz sand particles. It is believed that at the time of filing that with a reduced adhesion and sliding friction, the amorphous $SiO_2$ used in the form of spherical $SiO_2$ particles is able to space the molding material particles adjoining one another during the flowing process and allow same, via the swelling phase, to slide off one another on the spherical surfaces of the $SiO_2$ spheres with a reduced sliding resistance. It is believed that in the flowing process, the improved flow behavior can thus be explained by a permanent and friction-stable gel layer with particularly advantageous sliding friction properties on the amorphous $SiO_2$. In the contact points, the $SiO_2$ particles and the molding material particles are believed to be separated from one another by the stable swelling phase, with the sliding friction of the particle surfaces being determined by the swelling phase.

The embodiments of the inventive molding material mixture can advantageously be used in devices and processes which provide the drying of molding material mixtures on the basis of quartz sand and an aqueous alkali silicate binding agent without having to introduce any further design measures. Equally, it is believed that the partially dissolved $SiO_2$ only releases water during the drying process and permits a simple reaction process without there being any need for additional measures involving additional chemical processes or reaction products.

If the percentage of amorphous spherical $SiO_2$ exceeds 10 percent by weight, it has been found to use longer drying times for completely removing the water. It is believed that with an increased percentage of $SiO_2$ particles in the molding part, $SiO_2$ particles adjoining one another, increasingly, form joint contact points. It is believed that in the region of the joint contact points, there occur larger regions of adjoining, spatial water-containing networks of the swelling phase on the surface. The inventors are of the opinion that the longer drying times are due to the increased number of larger regions of water-containing networks. With a percentage of amorphous spherical $SiO_2$ of 1 to 10 percent by weight, there are obtained molding material mixtures which, reproducibly, after a constant drying time, comprise the necessary green strength.

Surprisingly, an amorphous, partially dissolved, spherical $SiO_2$, apart from the improved flowing ability, continued to exhibit an increase in the strength of the molding part produced from the molding material, with the surface of the $SiO_2$ being set to be alkaline. The inventors at the time of filing assume that the swelling phase formed on the surface of the amorphous $SiO_2$, during the drying process, provides with each contact point on an adjoining quartz sand particle an increased number of island-like binding centers for forming binding bridges.

Further advantageous effects are obtained and described with reference to the following embodiments. The embodiments serve to explain the invention, and their combination of characteristics is not to be interpreted as having a restrictive effect on the invention. Said characteristics can be used both individually and in a combined form within the framework of the invention.

The molding material was applied in the form of different mixtures, using the following starting materials:

Washed quartz sand of type H32, mean grain size 0.32 mm; an inorganic binding agent based on alkali silicate with a content of iron, cadmium and/or aluminum of 0.01 to 0.5%; amorphous, spherical $SiO_2$ with a percentage of particles greater than 45 micrometers of a maximum of 1.5% and a degree of purity in excess of 85%.

The mean grain size is determined in a granulometer according to the scattered light principle by means of a red light diode laser using multiplen detectors in a 15 ml upright cell with magnetic stirrer. The particle size analysis takes place by a laser diffraction method according to DIN/ISO 13320. The particles to be determined, together with a suitable dispersing agent, were transferred into a suspension. For measuring the grain size, 0.1 ml of the homogenized suspension was transferred into a measuring cell with distilled water, and the grain size was determined within one minute. The amorphous $SiO_2$ used had a mean grain size of 30 to 45 micrometers.

For determining the stable swelling phase, $SiO_2$ spheres in suspension were introduced into the measuring cell, and the grain size was determined at intervals of 30 seconds until, for several minutes, no further changes were identified.

EXAMPLE 1

Thermal Load Bearing Capacity of the Molding Parts

Two mixtures were prepared in a blade mixer within 3 minutes and subsequently shot on a core shooting machine to form 4 cores each. It was decided to use a suspension of amorphous $SiO_2$ previously prepared with part of a binding agent in order to obtain, in an accelerated way, a homogenous mixture of the components. The suspension has a pH value of 9.2 and was mixed together with the other components in the mixer, as described above. The shooting pressure amounted to 5 bar, the shooting time was 1 second and the vacuum applied amounted to 0.9 bar. The cores were pre-hardened in the core box for 30 seconds at 180° C. in the machine, removed in the form of green compacts, subsequently dried in a microwave oven for 3 minutes at 1000 watts and finally weighed. They were cores for casting a longitudinally extending bendable bolt of 185.4 mm by 22.7 mm by 22.7 mm. For casting purposes, use was made of a grey iron melt at a mean temperature of 1275° C.±25° C. in the casting ladle. The cast bolt was removed from the cores after a cooling time of 3 days. Subsequently, 4 bolts each were tested for their bending characteristics.

The bending characteristics of a casting result from the thermal load on the core during the casting operation, combined with the buoyancy force generated by the in-flowing metal. It is a measure for the temperature resistance and dimensional accuracy of a core material. The bending factor was determined on the finished bolts aligned transversely to the measuring device in the bolt center as the average deviation of the outer edges from the horizontal line. The molding material mixtures and the measured values are listed in the table below.

TABLE 1

| Casting of grey iron melt cont. 93% Fe, 3.3% C, 2% Si, 0.4% Mn impurities <0.05% | Reference core molding material mixture 5 kg core sand 120 g binding agent 5 g silicon oil bolt bending in mm | Inventive embodiment core molding material mixture 5 kg core sand 90 g binding agent 54 g $SiO_2$ bolt bending in mm |
|---|---|---|
| 1st bolt | 0.73 | 0.7 |
| 2nd bolt | 0.85 | 0.2 |
| 3rd bolt | 0.65 | 0.13 |
| 4th bolt | 0.65 | 0.23 |
| average | 0.72 | 0.31 |

The cores produced in accordance with embodiments of the invention confirm, on average, a low bending inclination of the cores during the casting operation.

A lower bending rate indicates that the molding part comprises an improved structure which is able to accommodate the deformation stresses occurring under thermal loads. The deformation stresses result from de-watering and sinter processes which are caused in the molding parts by the high temperature of the inflowing metal. The inventors assume that the uniformly distributed $SiO_2$ spheres, via their surface swelling phase, during the drying process, form a plurality of binding agent bridges with adjoining sand articles. As a result of the large number of small binding agent bridges, which connect particles, it is possible for deformation stresses to be distributed as a result of the homogeneous interlocking of the molding material particles via a plurality of binding agent bridges to larger volumes of molding parts and to be elastically compensated for.

The homogeneous fine type of interlocking is believed to explain the increased thermal load bearing capacity of a molding part produced in accordance with embodiments of the invention.

EXAMPLE 2

Density of Molding Parts

As described in example 1, two mixtures were cast to form a core. Four identical, bar-shaped cores of identical volumes were produced of each mixture. The mixtures and weights are listed in the table below.

TABLE 2

| | Reference mixture 5 kg core sand 120 g binding agent 5 g silicone oil Weight in grams | Invention Embodiment 5 kg core sand 90 g binding agent 72 g $SiO_2$ Weight in grams |
|---|---|---|
| 1st core | 140.9 | 142.6 |
| 2nd core | 138.8 | 142.7 |
| 3rd core | 142.4 | 141.3 |
| 4th core | 141.1 | 141.9 |
| Average | 140.8 | 142.13 |

On average, the inventive cores comprise a higher weight. In members of identical volumes, a higher weight corresponds to a higher density. It is believed that the only slight deviation of the individual core weight from the mean value can be explained by the improved flowing and densification behavior relative to the molding material mixture with silicone oil.

In spite of the added flowing agent, the reference mixture comprises a lower mean mass of the cores. Furthermore, the weights of the individual cores clearly feature greater deviations from the mean value.

The densities achieved comprise a more uniform, improved flowing ability of the molding material mixture while being shot into the mold. It is believed that the $SiO_2$ spheres with their swelling phase on their surface allow the molding material particles to slide past one another more easily. It is believed that the swelling phase permits the molding sand particles to slide more easily over the small-surface contact points on the $SiO_2$ spheres. This can explain why in the molding material mixture, during the flowing process, blocking inter-engaging quartz sand particles apparently occur to a lesser extent. It is believed that the individual sand particle comprises an improved mobility relative to the adjoining molding material particles and even at high shear forces such as they occur when the shooting operation takes place at an increased pressure, the molding material mixture comprises a more uniform and improved flowing ability.

As will be explained below, it is believed that the green strength and the end strength of the cores reflects the results of the weight determination. In the inventive embodiment cores, the green strength and the end strength determined under point load up to deformation fluctuate clearly to a lesser extent.

It is believed that the mixture in accordance with the embodiments of the invention made it possible, with a reduced binding agent content, to achieve more constant and higher densities in the cores produced.

EXAMPLE 3

End Strength of Molding Parts

To examine the influence of the added $SiO_2$ on the end strength of the cores, there was prepared a suspension of amorphous, spherical $SiO_2$ in a larger quantity of binding agent. Subsequently, a total of 4 batches with the further components were processed under the same conditions as described in example 1 into 4 cores in each case. Subsequently, there was prepared a reference mixture as described in example 2 and also processed into 4 cores.

The cores with the added $SiO_2$ all exhibited the increased density as known from example 1. The finish-dried cores were placed into a 3-point bending device and the force leading to the fracture of the core was determined. In the following table, said force is referred to as "breaking force". The cores with the added $SiO_2$ featured a bending strength which increased from core batch to core batch. This phenomenon was correlated with the pH value of the sequentially added $SiO_2$ binding agent suspension. A maximum bending strength was achieved at a constant pH value of the prepared suspension. The following table shows the pH value which was determined at the time when the suspension was added, the approximate holding time of the suspension and the average bending strength for each 4 cores.

TABLE 3

| | Suspension $SiO_2$ binding agent pH at point of addition | Suspension $SiO_2$ binding agent Holding time in minutes | Mean breaking force ± deviation in N |
|---|---|---|---|
| 1st batch | 12.4 | 0 | 165 ± 7 |
| 2nd batch | 11.8 | 4 | 195 ± 5 |
| 3rd batch | 11.5 | 7 | 202 ± 6 |
| 4th batch | 11.4 | 10 | 203 ± 4 |
| comparison mixture | — | — | 144 ± 17 |

Reference mixture: 5 kg core sand, 120 g binding agent, 5 g silicone oil. Embodiment of Invention: 4 batches each of 5 kg core sand, 90 g binding agent, 72 g $SiO_2$.

The table of example 3 shows that by adding partially dissolved, spherical, amorphous $SiO_2$ to a molding material mixture, the bending strength of a core produced therefrom is improved.

Furthermore, the influence of the pH value of the $SiO_2$ suspension becomes clear. First the pH value of the alkali suspension decreases, which it is believed can be explained by the use of $OH^-$ ions during the formation of the swelling phase. After 4 minutes the pH value is reduced by 0.6 pH; thereafter, this value changes only slightly. After approximately 4 minutes—according to the explanatory model of the inventors—the surface of the amorphous $SiO_2$ can be regarded as being fully partially dissolved and being surrounded by a swelling phase. The alkali, amorphous $SiO_2$ is accompanied by a clearly improved bending strength of the core as produced.

Further tests regarding the pH value stability in an alkali suspension of amorphous, spherical $SiO_2$ were carried out as described below.

An amorphous, spherical $SiO_2$ with a degree of purity and grain size characteristics as described above was suspended in an alkali silicate suspension and/or in a sodium hydroxide solution with a pH value of 9 to 14. The content of $SiO_2$ in the suspension ranged between 10 and 80 percent by weight, alternatively 20 to 79 percent by weight. The pH value of the alkali suspension was subsequently determined at intervals of 30 seconds. At the start of the test, the suspensions exhibited the above-described rapid decrease in the pH value. After no more than 4 minutes, the pH value, with a maximum change of approx. 0.1 pH per minute, was stable. After a maximum holding time of 10 minutes, the suspension of the alkali amorphous $SiO_2$ showed no further change in the pH value for several hours.

Apart from the improved flow behaviour as mentioned in example 2, the alkali $SiO_2$ suspensions with a stable pH value feature the improved end strength of the cores produced therefrom, as shown in table 3 of example 3.

With an alkali concentration which was clearly greater than the concentration of a batch for a pH value of 14, a slowly and surely decreasing core diameter of the $SiO_2$ particles was identified. It is believed that this can be explained by a slow dissolution of the $SiO_2$ particles as a result of the frequently over-stoichiometric concentration of alkali. Molding material mixtures produced in this way feature neither an improved flowing ability nor a better end strength of the molds produced, which can be explained by the deviating morphology of the dissolving $SiO_2$ surface.

It is believed that with a set pH value of less than 9, all suspensions did not achieve the formation of a swelling phase with an expansion of 1 to 2% within the first 4 minutes. If the expansion was less than 1%, the suspensions featured fluctuating improvements in the flowing ability apparently without achieving the flow ability values achieved previously with a stable swelling phase. Swelling phases which were characterized by an expansion of the mean grain diameter of 1 to 2% exhibited the above-described improved flowing ability. In the subsequent tests, the suspensions were set to a pH value of at least 9 in order, reliably, to achieve within the first 4 minutes a stable pH value and a swelling phase with an expansion of the mean grain diameter of the original, dry $SiO_2$ of 1 to 2%.

Advantageously improved molding parts were found in further tests with mixtures wherein the mean grain size of the sand particles and the mean grain size of the amorphous $SiO_2$ were identical. For example, there were prepared molding material mixtures which contained a classified and sorted quartz sand fraction with a grain size in the range of 0.01 mm, which corresponds to 10 micrometers, and 1 to 10% amorphous, spherical $SiO_2$ with a mean grain diameter between 10 and 45 micrometers. At the same stirring speed, such molding material mixtures provided a homogeneous mixture in a shorter time and during the production of the molding part, even at a lower shooting pressure, achieved molding parts with an improved density and uniformity and greater profile accuracy.

The results of example 2 support the theory that a continuous, stable alkaline swelling phase on the amorphous $SiO_2$ whose surface has been activated, contributes to the formation of binding agent bridges through additional binding centres. It can be assumed that the surface of such an alkali $SiO_2$ is characterized by negatively charged oxygen groups.

More particularly in plants in which the individual components of a molding material mixture are stored for several days in large containers, the alkali $SiO_2$ suspension can be advantageously produced by mixing dry, amorphous, spherical $SiO_2$ with an alkaline binding agent. By producing the suspension directly prior to being used, the amorphous $SiO_2$ is set to be alkaline in a fresh condition and in a uniform quality. With a percentage of 1 to 10 percent by weight of $SiO_2$ freshly set to be alkaline, with reference to the quantity of sand, it was possible, in the tests, to provide a molding material mixture with an improved flowing ability and an increased end strength of the molding parts produced therefrom.

Molding material mixtures with further additives which consisted of phosphoric and/or boric acid were found to be disadvantageous. Such additives which are known to be used for improving inorganic binding agents decrease the pH value in the molding material mixtures and adversely affect the flowing ability of the mixture. It was found that binding agents based on alkali silicate with acid additives react by forming salts. With a binding agent purely based on alkali silicate without any additives of the above-mentioned type with a binding agent content of 1 to 10% of the total mixture, the effects in accordance with the invention were reliably identified.

Furthermore, slightly basic accompanying substances such as metal oxides which can be bound into silicate structures were found to reduce the drying time. As compared to a pure alkali silicate binding agent, a binding agent based on alkali silicate with a content of iron, aluminum and/or cadmium of 0.01 to 0.50% was found to reduce the drying time by 5% when producing molding parts.

The inventive embodiment mixture achieves a higher end strength of the cores.

EXAMPLE 4

Properties in the Casting Process

In order to test the inclination of an inventive molding material to form adhesion bridges during casting, there were prepared two mixtures as described in example 2 and processed to form 4 cores each. The cores were designed for casting bolts whose cross-section has an H-profile. During the casting process, there is thus offered an increased surface for the formation of possible adhesion bridges. As above, use was made of a grey iron melt with a mean temperature of 1275° C.±25° C. in the casting ladle, and the cast bolt was removed from the cores after a cooling time of 3 days. First the bolts were vibrated by a hammer and subsequently, if necessary, freed of the adhering core parts by a mandrel, cleaned and finally tested for stubborn adhesions and metal penetration.

Molding material mixtures and assessment of adhesions are listed in the table below.

TABLE 4

| Casting a grey iron melt containing 93% Fe, 3.3% C, 2% Si, 0.4% Mn impurities <0.05% | Reference core molding material mixture<br>5 kg core sand<br>120 g binding agent<br>5 kg silicone oil | Inventive embodiment core molding material mixture<br>5 kg core sand<br>90 g binding agent<br>54 g $SiO_2$ |
|---|---|---|
| 1st bolt | hammer/mandrel/A | hammer/—/A |
| 2nd bolt | hammer/mandrel/A, V | hammer/—/A |
| 3rd bolt | hammer/mandrel/A, V | hammer/—/A |
| 4th bolt | hammer/mandrel/A | hammer/—/A |

hammer = vibrating the bolt contained in the core by a hammer
mandrel = if necessary, freeing the bolt by using a mandrel
A = adhesions of core sand;
V = metal penetration After having been cast, the inventive embodiment cores can be easily removed by several hammer blows. The bolts exposed in this way still contain sand adhesions which were removed in an ultrasound bath.

The reference cores were only partially removed from the bolts by hammer blows. After the bolts were exposed by a mandrel, the bolts were cleaned in an ultrasound bath and subsequently tested. On the one hand, there were found stubborn sand adhesions which were removed by a mandrel. On the other hand, there was found metal penetration in the case of which the adhering sand could only be partially removed by the application of high forces as a result of which the bolt surface was damaged.

The comparison showed that the inventive molding material mixture was removed much more easily and more quickly after the casting operation. Cores produced from the inventive embodiment molding material resulted in the production of castings with easily removable, slight sand adhesions. Metal penetration such as it occurred in the reference castings was not found.

EXAMPLE 5

Disintegration of the Molding Parts

To test the disintegration properties of molding parts of the inventive embodiment molding material mixture, there were prepared two mixtures as described in example 2 and processed to form 4 cores each. After the casting operation, the cores were tested for their disintegration properties. As already described, use was made of a grey iron melt in the casting ladle, and the molding parts with the cast bolts were tested after a cooling time of 3 days. The molding parts were tested after the castings connected to a vibration generating device were aligned in an overhead position. The vibration generating device subjected the casting to a 30 Hertz vibration with a pulse peak of up to 1.4 kW power. In the process, the time was measured within which 90% as well as 99% of the molding part had fallen off the casting.

The molding material mixtures and the assessment of the disintegration properties are listed in the following table.

TABLE 5

| Molding part with cast part of a grey iron melt (93% Fe, 3.3% C, 2% Si, 0.4% Mn) | Reference molding part Molding material mix 5 kg core sand 120 binding agent 5 g silicone oil | | Inventive embodiment core Mold material mix 5 kg core sand 90 g binding agent 54 g $SiO_2$ | |
|---|---|---|---|---|
| impurities <0.05% | 90% | 99% | 90% | 99% |
| 1 bolt | 8.2 sec. | 11.3 sec. | 4.2 sec. | 9.2 sec. |
| 2nd bolt | 7.4 sec. | 11.8 sec. | 4.4 sec. | 9.4 sec. |
| 3rd bolt | 7.6 sec. | 11.3 sec. | 4.6 sec. | 9.3 sec. |
| 4th bolt | 7.7 sec. | 11.4 sec. | 4.4 sec. | 9.5 sec. |
| Average | 7.7 sec. | 11.5 sec. | 4.4 sec. | 9.4 sec. |

After the casting operation, the molding parts of the inventive embodiment mixture clearly exhibit shorter times for removing the molding part from the casting. The molding parts of the inventive embodiment mixture featured a rapidly spreading, small-cell crack pattern which, shortly afterwards, lead to a uniform peeling of the molding part into small-part segments. Any remaining adhering sand on the casting surface was removed in an ultrasound bath or even manually with a simple cloth.

The disintegration behavior of the reference mixture clearly exhibited longer peeling times and irregular crack formations in the molding part as well as irregular peeling into different sized segments. Furthermore, after 99 percent by weight of the molding part had been peeled off, the surface is still covered with strongly adhering sand grains which, in contrast to the inventive embodiment mixture, could not be completely removed, neither manually nor in the ultrasound bath.

The inventors attribute the superior disintegration behavior to uniformly formed, interlocking binding agent bridges between the sand particles and the amorphous $SiO_2$. The large number of uniformly distributed binding agent bridges, on the one hand, increases the strength and elasticity of the molding part, but on the other hand, locally and with reference to the individual binding agent bridge, under the influence of an abrupt pulse, they can be broken by a much reduced force. The interlocking of the bridges is thus more uniform, but also much less pronounced than is the case with the reference mixture. The increased number of binding agent bridges combined with a reduced load bearing capacity of the individual bridges thus results in an advantageous combination of improved strength and a more advantageous disintegration behavior.

After the removal of the core after the casting operation, the inventive embodiment molding parts feature a more rapid and more uniform disintegration behavior.

The inventive embodiment molding material mixture permits the production of molding parts which, during the subsequent casting operation, have a more uniform compensating effect under thermal loads. The castings now accessible are characterized by an improved accuracy of shape, which is believed can be explained by the uniform interlocking of the molding material particles via the binding agent bridges formed by the amorphous, partially dissolved $SiO_2$.

The densification behavior of the molding material mixture prepared in accordance with embodiments of the invention was particularly advantageous. It was possible to achieve an excellent flow ability and a very uniform packing density.

Table 3 shows a slight fluctuation in the strength values, which explains the high degree of uniformity of the molding parts produced in accordance with the embodiments of invention.

As far as the disintegration behavior is concerned, the molding parts, after the casting operation, are characterized by a uniform, improved crack formation and, quite clearly, quicker core removal times.

The swelling phase formed on the $SiO_2$ particles, in connection with the uniform packing density, results in a high bending strength of the bolt portions produced by the cores. The swelling layer exhibits a very small degree of interlocking as compared to a $SiO_2$-containing molding material mixture strengthened via pure binding agent bridges. The low degree of interlocking leads to small, locally delimited adhesion islands (module block adhesion) which, following the use of cores, accelerate disintegration (micro-fractures). The disintegration behavior of the inventive molding materials and molding parts therefore had to be regarded as surprisingly advantageous. There was no need for any additional aids of any kind.

One feature or aspect of an embodiment is believed at the time of the filing of this patent application to possibly reside broadly in a molding material or molding part for foundry purposes, comprising 1-10% of binding agent based on alkali silicate, an aggregate containing 1-10 percent by weight of amorphous silicon dioxide, remainder quartz sand with a grain size range of 0.01 to 5 mm, wherein the amorphous silicon dioxide is present in a spherical shape, wherein the percentage of particles with a diameter of 45 or more μm amounts to a maximum of 1.5 percent by weight; that on the surface of the amorphous silicon dioxide, there is formed a swelling phase comprising a thickness of 0.5 to 1% with reference to the mean grain diameter.

The components disclosed in the various publications, disclosed or incorporated by reference herein, may possibly be used in possible embodiments of the present invention, as well as equivalents thereof.

Another feature or aspect of an embodiment is believed at the time of the filing of this patent application to possibly reside broadly in the molding material or molding part, wherein the mean grain diameter of the amorphous silicon dioxide ranges between 10 and 45 μm.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Yet another feature or aspect of an embodiment is believed at the time of the filing of this patent application to possibly reside broadly in the molding material or molding part, wherein the amorphous silicon dioxide comprises a degree of purity in excess of 85%.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

Still another feature or aspect of an embodiment is believed at the time of the filing of this patent application to possibly reside broadly in the molding material or molding part wherein, on its surface, the silicon dioxide set to be alkali comprises negatively charged oxygen groups.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

A further feature or aspect of an embodiment is believed at the time of the filing of this patent application to possibly reside broadly in the molding material or molding part, wherein between the silicon dioxide set to be alkali and the quartz sand, there are formed binding agent bridges via additional binding centers.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Another feature or aspect of an embodiment is believed at the time of the filing of this patent application to possibly reside broadly in the molding material or molding part, wherein the binding agent comprises a content of iron, aluminum and/or cadmium of 0.01 to 0.50%.

All, or substantially all, of the components and methods of the various embodiments may be used with at least one embodiment or all of the embodiments, if more than one embodiment is described herein.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Yet another feature or aspect of an embodiment is believed at the time of the filing of this patent application to possibly reside broadly in a process of producing a molding material or molding part for foundry purposes, wherein as the aggregate, an amorphous, partially dissolved, spherical $SiO_2$ with a percentage of particles with a grain size in excess of 45 μm is transferred into a suspension with a solid matter content of 20 to 70% silicon dioxide, with a pH-value of 9-14 being set, that the amorphous silicon dioxide is held during the alkaline treatment for at least 4 minutes until the swelling phase has formed on the silicon dioxide surface, that the silicon dioxide is homogeneously mixed with molding sand and binding agent, wherein the mixing ratio of binding agent/$SiO_2$ to molding sand is held at a ratio of 1 to 10 to 90, that the silicon dioxide, together with the molding sand and the binding agent is shot under pressure into a molding box and dried to form a finished core.

All of the patents, patent applications and publications recited herein, and in the Declaration attached hereto, are hereby incorporated by reference as if set forth in their entirety herein.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Still another feature or aspect of an embodiment is believed at the time of the filing of this patent application to possibly reside broadly in the process, wherein the surface of the amorphous silicon dioxide is partially dissolved, wherein the mean grain diameter of the silicon dioxide is widened by 2% and a swelling phase is formed.

The corresponding foreign and international patent publication applications, namely, Federal Republic of Germany Patent Application No. 10 2006 036 381.7, filed on Aug. 2, 2006, having inventor Ralf-Joachim GERLACH, and DE-OS 10 2006 036 381.7 and DE-PS 10 2006 036 381.7, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

A further feature or aspect of an embodiment is believed at the time of the filing of this patent application to possibly reside broadly in the process, wherein the treatment for forming a swelling phase, starting with a set pH-value ranging between 9 and 14, is ended after a maximum of 10 minutes.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Another feature or aspect of an embodiment is believed at the time of the filing of this patent application to possibly reside broadly in the process, wherein the set pH-value ranging between 9 and 14 percent is lowered with a maximum modification of 0.1 pH per minute.

The sentence immediately above relates to patents, published patent applications and other documents either incorporated by reference or not incorporated by reference.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

The invention claimed is:

1. A molding material or molding part for foundry purposes, comprising 1-10% by weight of binding agent based on alkali silicate, an aggregate containing 1-10 percent by weight of amorphous silicon dioxide, remainder quartz sand with a grain size range of 0.01 to 5 mm, the amorphous silicon dioxide comprising a spherical shape, wherein the percentage of particles with a diameter of 45 or more μm amounts to a maximum of 1.5 percent by weight of the amorphous silicon dioxide, the amorphous silicon dioxide comprising a surface of the amorphous silicon dioxide, with a swelling phase comprising a thickness of 0.5 to 1% of the mean grain diameter of the amorphous silicon dioxide.

2. A molding material or molding part according to claim 1, wherein the mean grain diameter of the amorphous silicon dioxide ranges between 10 and 45 μm.

3. A molding material or molding part according to claim 2, wherein the amorphous silicon dioxide comprises a degree of purity in excess of 85%.

4. A molding material or molding part according to claim 3, wherein on its surface, the silicon dioxide set to be alkali comprises negatively charged oxygen groups.

5. A molding material or molding part according to claim 4, wherein between the silicon dioxide set to be alkali and the quartz sand, there are formed binding agent bridges via additional binding centers.

6. A molding material or molding part according to claim 5, wherein the binding agent comprises a content of iron, aluminum and/or cadmium of 0.01 to 0.50%.

7. A process of producing a molding material or molding part for foundry purposes, said molding material or molding part for foundry purposes comprising of 1-10% by weight of binding agent based on alkali silicate, an aggregate containing 1-10 percent by weight of amorphous silicon dioxide, remainder quartz sand with a grain size range of 0.01 to 5 mm, the amorphous silicon dioxide comprising a spherical shape, wherein the percentage of particles with a diameter of 45 or more μm amounts to a maximum of 1.5 percent by weight of the amorphous silicon dioxide, the amorphous silicon dioxide comprising a surface of the amorphous silicon dioxide, with a swelling phase comprising a thickness of 0.5 to 1% of the mean grain diameter of the amorphous silicon dioxide; said process comprising the steps of:

transferring said amorphous silicon dioxide particles comprising an amorphous, partially dissolved, spherical $SiO_2$ with a percentage of particles with a grain size in excess of 45 μm into a suspension with a solid matter content of 20 to 70% silicon dioxide, with a pH-value of 9-14 being set;

holding the amorphous silicon dioxide during the alkaline treatment for at least 4 minutes until a swelling phase has formed on the silicon dioxide surface;

mixing the silicon dioxide homogeneously with molding sand and binding agent, wherein the mixing ratio of the combination of binding agent and $SiO_2$ to the molding sand is held at a ratio from 1 to 10 to 1 to 90;

shooting the silicon dioxide, together with the molding sand and the binding agent, under pressure into a molding box; and drying the silicon dioxide, molding sand, and binding agent to form a finished core.

8. A process according to claim 7, wherein the surface of the amorphous silicon dioxide is partially dissolved, wherein the mean grain diameter of the silicon dioxide is widened by 2% and a swelling phase is formed.

9. A process according to claim 7, wherein the treatment for forming a swelling phase, starting with a set pH-value ranging between 9 and 14, is ended after a maximum of 10 minutes.

10. A process according to claim 8, wherein the treatment for forming a swelling phase, starting with a set pH-value ranging between 9 and 14, is ended after a maximum of 10 minutes.

11. A process according to claim 7, wherein the set pH-value ranging between 9 and 14 is lowered with a maximum modification of 0.1 pH per minute.

12. A process according to claim 8, wherein the set pH-value ranging between 9 and 14 is lowered with a maximum modification of 0.1 pH per minute.

13. A process according to claim 9, wherein the set pH-value ranging between 9 and 14 is lowered with a maximum modification of 0.1 pH per minute.

14. A process according to claim 7, wherein the mean grain diameter of the amorphous silicon dioxide ranges between 10 and 45 μm.

15. A process according to claim 7, wherein the amorphous silicon dioxide comprises a degree of purity in excess of 85%.

16. A process according to claim 7, wherein on its surface, the silicon dioxide set to be alkali comprises negatively charged oxygen groups.

17. A process according to claim 7, wherein between the silicon dioxide set to be alkali and the quartz sand, there are formed binding agent bridges via additional binding centers.

18. A process according to claim 7, wherein the binding agent comprises a content of iron, aluminum and/or cadmium of 0.01 to 0.50%.

* * * * *